United States Patent [19]

Stock et al.

[11] Patent Number: 5,014,070

[45] Date of Patent: May 7, 1991

[54] RADAR CAMOUFLAGE MATERIAL

[75] Inventors: Don J. R. Stock, Lonsee; Eberhard Eckert, Bonn, both of Fed. Rep. of Germany

[73] Assignee: Licentia Patent-Verwaltungs GmbH, Frankfurt, Fed. Rep. of Germany

[21] Appl. No.: 216,578

[22] Filed: Jul. 8, 1988

[30] Foreign Application Priority Data

Jul. 10, 1987 [DE] Fed. Rep. of Germany ..... 3722793

[51] Int. Cl.[5] ..... H01Q 1/38; H01Q 13/08; H01Q 19/06; H01Q 3/22

[52] U.S. Cl. ..... 343/700 MS; 343/754; 342/368

[58] Field of Search ..... 343/700 MS, 705, 909, 343/756, 753, 754; 342/2, 3, 4, 7, 1, 5, 368

[56] References Cited

U.S. PATENT DOCUMENTS

| | | | |
|---|---|---|---|
| 4,123,759 | 10/1978 | Hines et al. | 343/854 |
| 4,264,881 | 4/1981 | DeRonde | 333/110 |
| 4,364,050 | 12/1982 | Lopez | 343/700 MS |
| 4,543,579 | 9/1985 | Teshirogi | 343/365 |
| 4,554,549 | 11/1985 | Fasseft et al. | 343/700 MS |
| 4,581,284 | 4/1986 | Eggert et al. | 428/283 |
| 4,684,952 | 8/1987 | Munson et al. | 343/700 MS |
| 4,697,189 | 9/1987 | Ness | 343/700 MS |
| 4,823,145 | 4/1989 | Mayes et al. | 343/700 MS |

OTHER PUBLICATIONS

A Microstrip Array of Concentric Annular Rings, Bhattacharyya et al. IEEE Trans on Ant. & Prop. AP-33 No. 6, Jun. 85, pp. 655-659.

Microstrip Ant, J. Q. Howell, IEEE Trans on Ant. & Prop. vol. AP 23 No. 1, Jan. 1975, pp. 90-93.

Synth. of Random Ant Array Patterns with Prescribed Nulls, Bar-Ness et al. IEEE Trans on Ant. & Prop. vol. AP32, No. 12, Dec. 84, pp. 1298-1307.

Conformal Microstrip Antennas and Microstrip Phased Arrays, Munson, IEEE Trans on Ant & Prop AP22 No. 1. Jan. 1974 pp. 74-78.

W. K. Kahn et al., "Minimum-Scattering Antennas", IEEE Transactions on Antennas and Propagation, vol. AP-13, Sep. 1965, pp. 671-675.

Jorgen Appel-Hansen, "Accurate Determination of Gain and Radiation Patterns by Radar Cross-Section Measurements", IEEE Transactions on Antennas and Propagation, vol. AP-27, No. 5, Sep. 1979, pp. 640-646.

M. B. Amin et al, "Techniques for utilization of hexagonal ferrites in radar absorbers—Part 1 Broadband planar coatings", The Radio and Electronic Engineer, vol. 51, No. 5, May 1981, pp. 209-218.

*Primary Examiner*—Michael C. Wimer
*Assistant Examiner*—Peter Toby Brown
*Attorney, Agent, or Firm*—Spencer & Frank

[57] ABSTRACT

A radar camouflage material for reducing the radar back-scatter cross section of a target object including a thin layer or foil of dielectric material provided with a plurality of individual antenna elements of the minimum-scatter antenna type, preferably ring antennas, which are loaded purely reactively.

8 Claims, 4 Drawing Sheets

RADAR CAMOUFLAGE MATERIAL

BACKGROUND OF THE INVENTION

The present invention relates to a radar camouflage material for reducing the radar back-scatter cross-section of a target object.

Radar camouflage materials are intended to protect a target object, e.g. an airplane, against detection by enemy radar or at least to make detection more difficult. Known and used for this purpose are, for example, lossy dielectric materials of various types. The major problem with such known camouflage materials is that the layers of dielectric materials required for effective camouflage are too thick to be suitable as a camouflage for aircraft.

European Patent No. 0,121,655.A2, corresponding to U.S. Pat. No. 4,581,284, discloses a composite fiber material in which, for example, soot or iron powder is embedded in such a manner that absorption of radar beams is possible. Since this material can be employed only wherever the manufacturing process includes structural aircraft components made of composite fiber materials, this material does not offer an actual solution for the problem of camouflaging metal parts.

The periodical "The Radio and Electronic Engineer", Volume 51, 1981, pages 209–218, describes a method in which hexagonal ferrites are used in camouflage layers. This produces a greater attenuation loss for the radar waves over a greater frequency range than is the case if only lossy dielectric materials are employed. Additionally, camouflage materials containing ferrites are usually thinner. In this case, a plurality of ferrite material layers are arranged one on top of the other to produce the appropriate attenuation bandwidth. This requires an expensive manufacturing process which primarily makes repairs of damaged aircraft parts more difficult.

European Patent No. 0,104,536.A2, corresponding to U.S. Pat. No. 4,684,952, discloses a method in which an antenna is constructed according to the so-called microstrip technology. This antenna is composed of a plurality of metal foil patches applied to a dielectric material to form an array. By interconnecting the antenna elements with lossy loads, the electromagnetic radiation incident on the array is partially absorbed. This causes the array to camouflage the covered surface.

SUMMARY OF THE INVENTION

It is an object of the present invention to provide a radar camouflage material which is thin in structure and easy to manufacture.

The above object is generally achieved according to the present invention by radar camouflage material, for reducing the radar back-scatter cross section of a target object, which comprises a thin layer of dielectric material, having a plurality of antenna elements disposed thereon, with the antenna elements being minimum-scatter type antennas which are terminated in a purely reactive manner. Preferably, the antenna elements are ring antennas.

According to one embodiment of the invention, the ring antennas are each configured as open rings whose ends are connected with an open or short-circuited line section of a desired length. According to a preferred embodiment of the invention, the ring antennas are each configured as closed rings. The ring antennas are formed as conductive films disposed on one surface of the layer of dielectric material, e.g. by etching and are arranged in an array disposed over the surface of the dielectric layer.

BRIEF DESCRIPTION OF THE DRAWINGS

FIG. 4*a* is a schematic plan view of an array similar to that of FIG. 4 with the opening in the ring type antenna elements being randomly oriented.

DETAILED DESCRIPTION OF THE PREFERRED EMBODIMENTS

Minimum-scatter antennas and their scattering characteristics are known and are discussed, for example, in an article by W.K. Kahn et al in IEEE Transactions on Antennas and Propagation, Volume, AP-13, (September 1965) pages 671–675and in an article by J. Appel-Hansen in IEEE Transactions on Antennas and Propagation, Volume Ap-27, (September 1979), pages 640–646. Of primary importance for the present invention is that dipole antennas and ring antennas meet the requirements for minimum-scatter antennas. These minimum-scatter antenna elements can be produced in a simple manner, for example, as etched conductor structures on one surface of a thin dielectric layer (foil). No lossy embedments in the dielectric material are required, and consequently manufacture and processing is significantly facilitated. The minimum scatter antenna elements are all loaded purely reactively, e.g. by way of line sections which are either open (idle) or are terminated by a short-circuit. The other opposite surface of the thin layer of dielectric material is preferably completely metallized.

Figure 1:
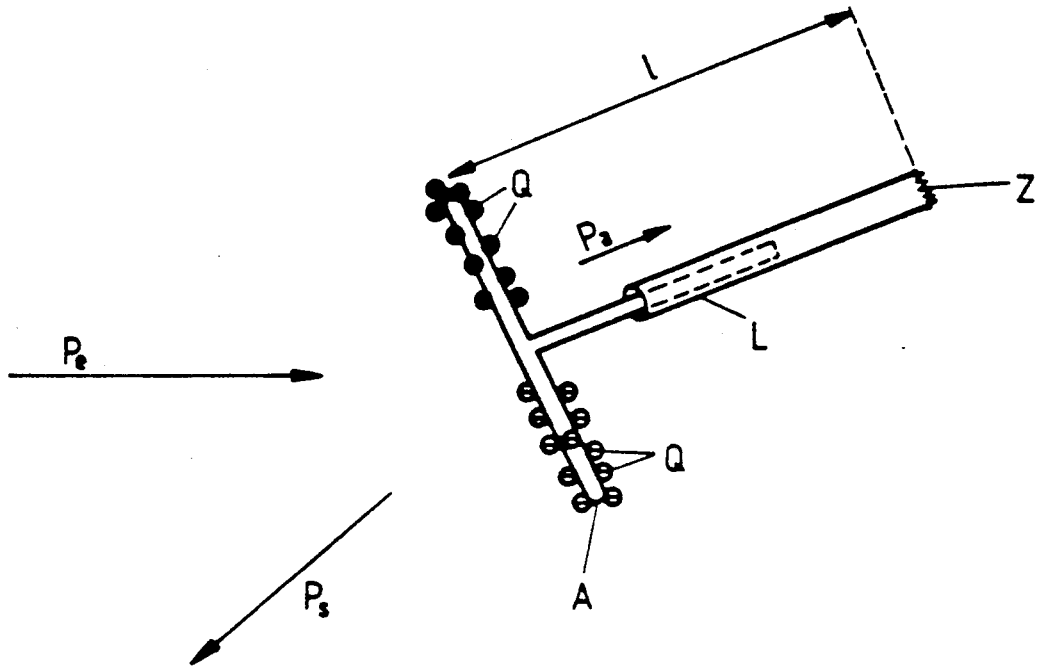
FIG. 1 is a schematic illustration of a dipole antenna element terminated by a load via a variable line section and used to explain the present invention.

To further describe the effect of the radar camouflage material according to the invention, reference is made to FIG. 1.

An antenna element A is assumed to be connected to a load Z by way of a line section L having a length l. If an electromagnetic wave $P_e$ impinges on the antenna element A, two effects can be observed and must be distinguished:

(a) part of the power of the incident wave flows along line L to the load Z, with this part of the power being called the received power $P_a$;

(b) in the antenna structure, i.e. the conductive components of the antenna element, charges Q are induced through which part of the power (called the scattered power $P_s$) is scattered back into space with the charges Q here serving as sources.

For minimum-scatter antenna elements, the power components $P_a$ and $P_s$ are of the same magnitude, while for all other antennas the scattered power $P_s$ is greater than the received power $P_a$.

As a model, let it be assumed that the length l of line section L is variable, e.g., by means of a line stretcher as schematically shown. If load Z is purely reactive, i.e. an idle circuit or a short-circuit, the entire received power $P_a$ is reflected back toward the antenna A after passing through the line section L. By means of the line stretcher, the reflected wave can be returned to the antenna element A with such a phase that back-scatter of the incident wave becomes minimal.

Preferably, the antenna elements are constructed as ring antennas. If a plurality of such minimum-scatter ring antennas are combined into an array, a camouflage surface results, with the line lengths of the respective individual antenna systems being tuned to a certain desired frequency. The line sections L are preferably applied to the rear surface of the dielectric substrate on which the array is formed in a manner so that they are entirely insulated from the metallization on the rear surface.

According to a preferred embodiment of the invention, the minimum scatter antenna elements are configured as closed rings, which corresponds to a reduction of the line length to zero. The camouflage characteristic at a desired frequency can then be set by way of the ring dimensions.

Figure 2:
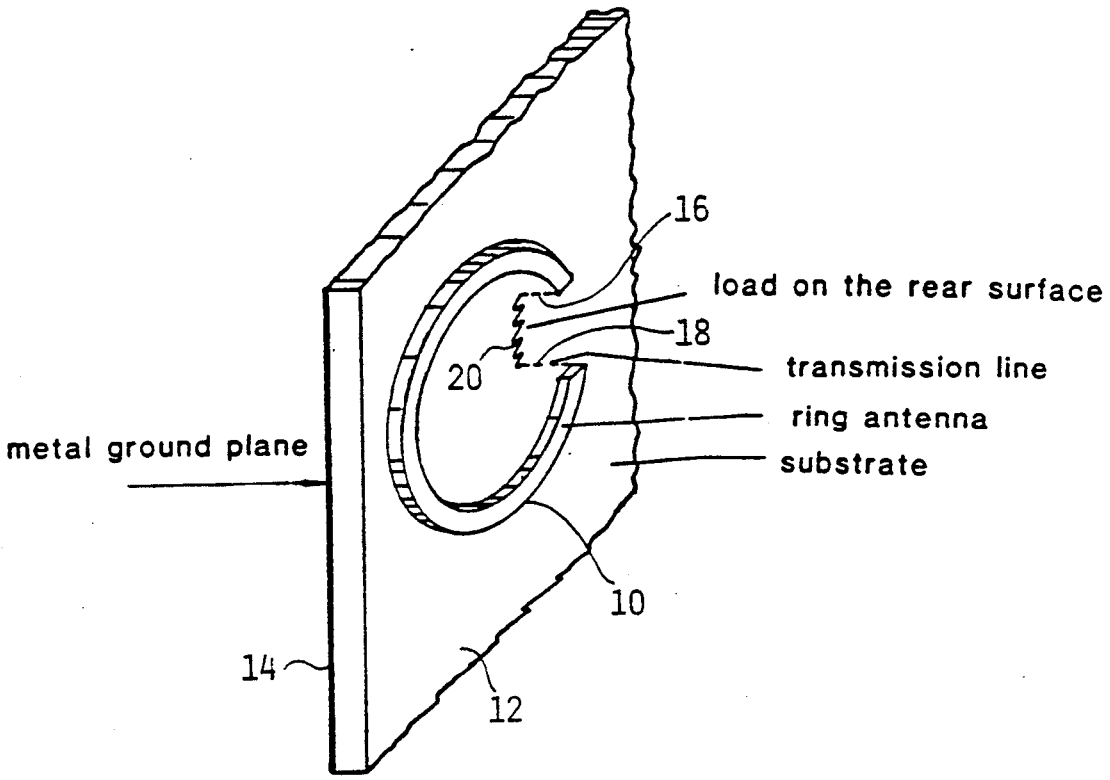
FIG. 2 is a schematic illustration of an open ring antenna according to one embodiment of the invention.

Turning now to FIG. 2, there is shown an open ring antenna for use in the present invention which includes a conductive open ring 10 disposed on one surface of a dielectric substrate 12 whose opposite or rear surface is covered by a layer of metal 14 to form a ground plane. In the illustrated embodiment, the transmission line is formed solely by two contact pins 16 and 18 which extend through the substrate 12 and which connect the respective ends of the ring 10 to a load (or short circuit) 20 which is applied to the rear surface of the substrate 12 but insulated from the metal layer 14.

Figure 5:
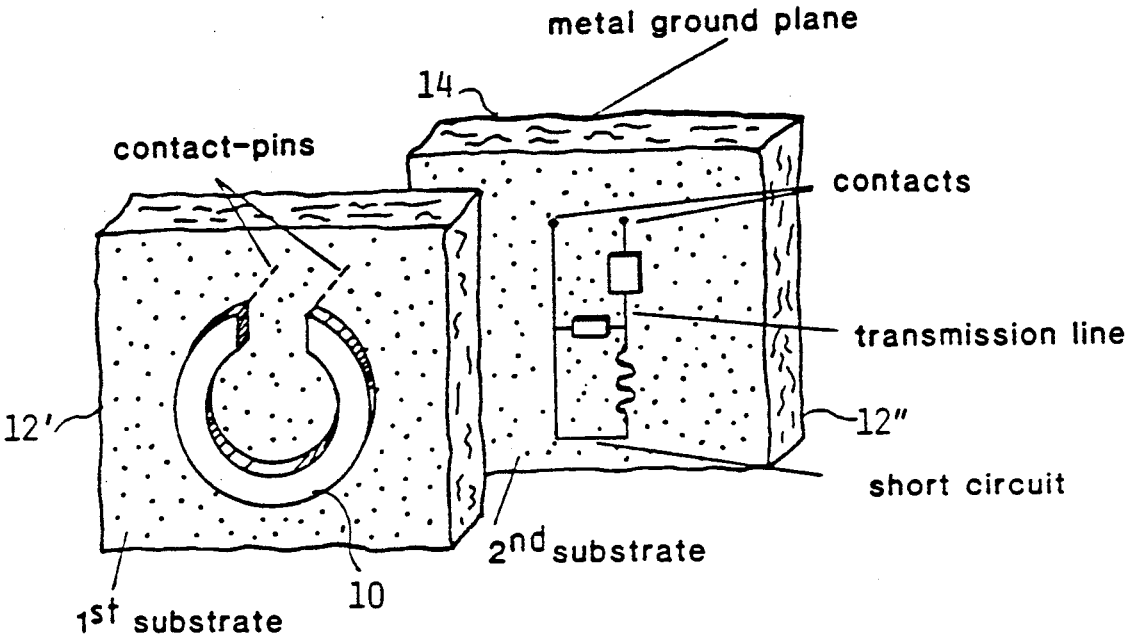
FIG. 5 is a schematic illustration of a ring antenna of the type shown in FIG. 2 showing the principle on which the present invention is based.

The principle of FIG. 2 may be shown with reference to FIG. 5. As shown in FIG. 5, the conducting open ring 10 on a first substrate 12' is connected, via contact pins extending through the substrate 12', to a second substrate 12'' on which the transmission line of FIG. 2 is shown as an equivalent T-network. The T-network is loaded by a short circuit. Using known circuit principles, one skilled in the art can adjust the T-network parameters (the line length L) until the EM-wave reflected from the short circuit cancels the wave scattered from the ring 10.

Since the use of two substrates as shown in FIG. 5 increases the manufacturing costs, the circuit consisting of the ring and the shorted transmission line is preferably disposed on a single substrate with the short circuit insulated from the ground plane. As a further simplification, the dielectric constant $\epsilon$ and thickness of the single substrate may be chosen so that the line length equals the thickness of the substrate. It is in fact possible to choose a dielectric constant $\epsilon$ so that the required line length is appreciably shorter than the substrate thickness. A suitable ring antenna segment as shown in FIG. 2 may be designed using, for example the equations of C. Wood in IEEE Journal of Microwaves, Optics and Acoustics, Jan. 1979, pp. 5–13.

Figure 3:
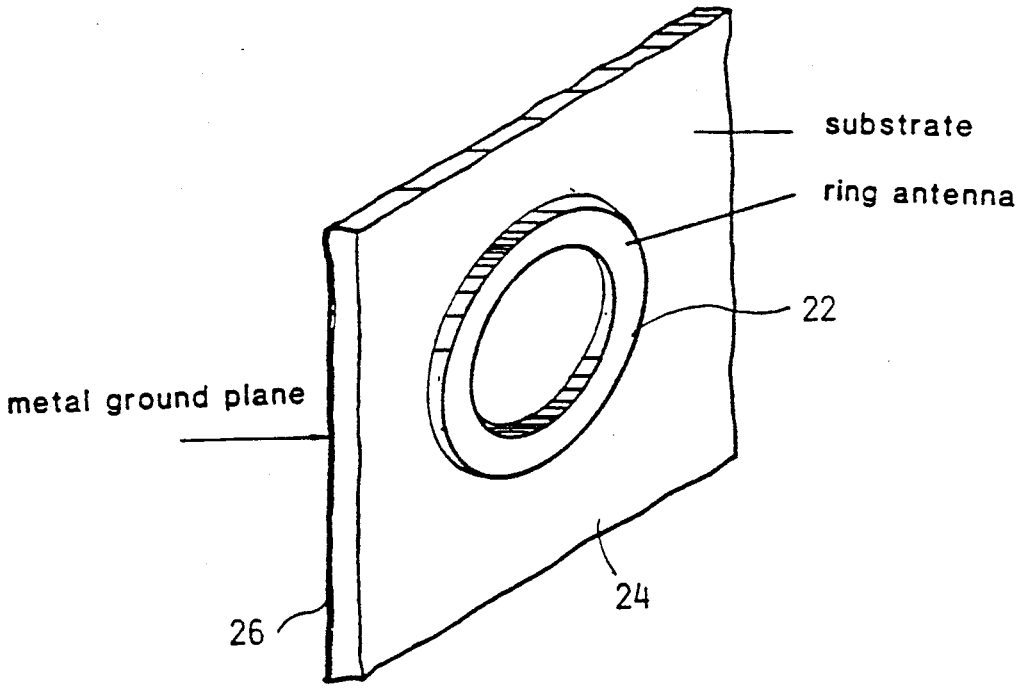
FIG. 3 is a schematic illustration of a closed ring antenna according to a further embodiment of the invention.

FIG. 3 shows a realization of a ring antenna without a connected load. As shown, the antenna is formed by a closed conductive ring 22 formed on one surface of a dielectric substrate 24 whose opposite surface is again provided with a metal ground plane or plate 26. The ground plate 26 serves as a short circuit and the thickness and material constant $\epsilon$ of the substrate 24 are so chosen to supply the cancelling wave at the ring 22.

Figure 4:
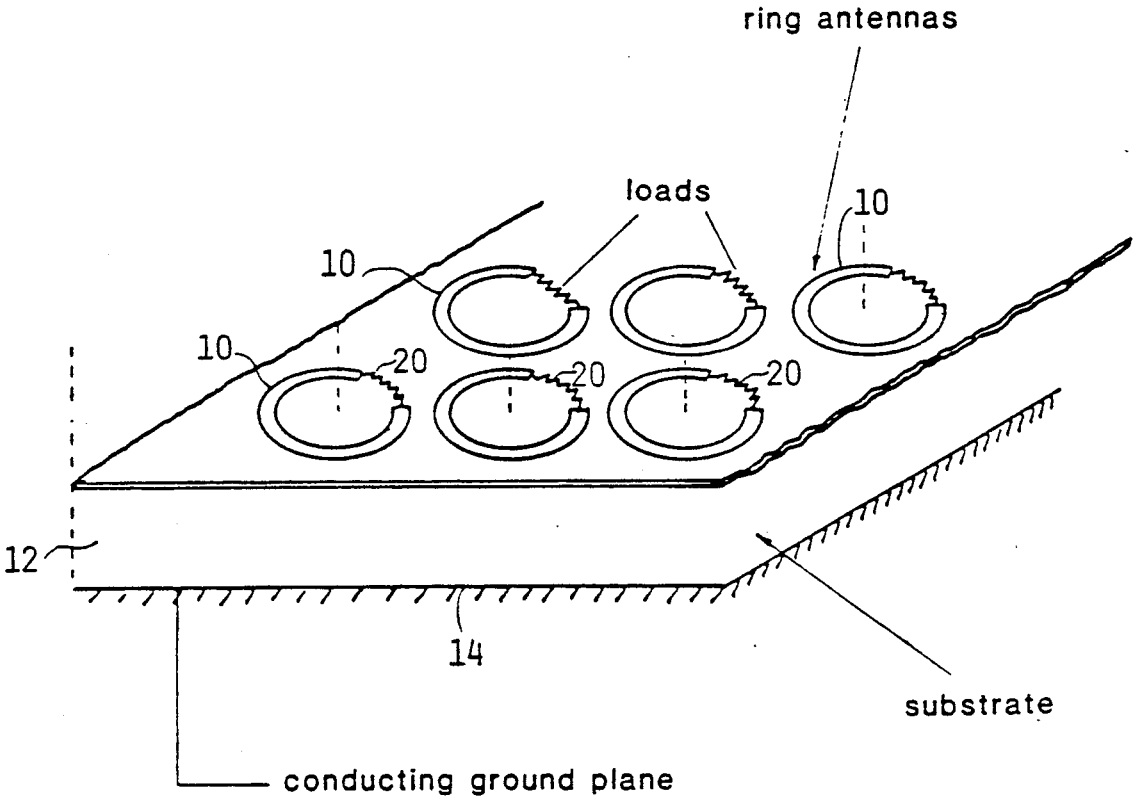
FIG. 4 is a schematic illustration of a possible array of ring antennas as shown in FIG. 2 as a camouflage material according to the invention.

FIG. 4 shows a possible embodiment of an array of ring antennas as shown in FIG. 2 to form a camouflage material. The individual rings 10 are spaced by $\lambda/4$. To reduce the polarization sensitivity of the array, it is desirable to orient the cut-out or open sections of the rings in random directions in the plane of the surface of the substrate 12 as shown in FIG. 4*a*.

Figure 6:
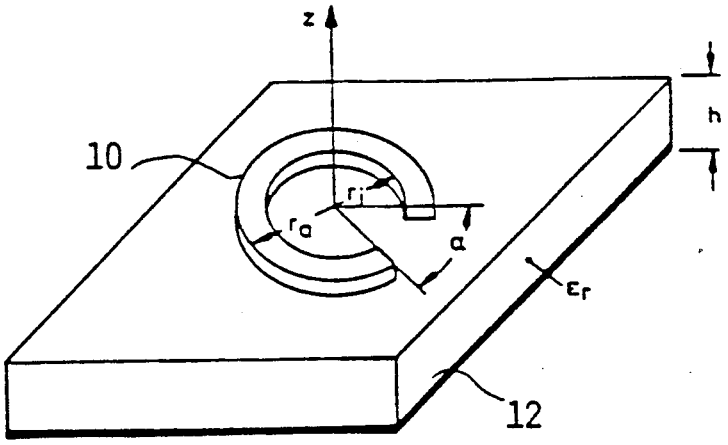
FIG. 6 is a schematic illustration showing a practical example of a ring antenna according to the invention.

FIG. 6 illustrates a practical example of an open ring antenna according to the invention. Although a flexible material would be used in the construction of the camouflage material, commercially available Polyguide, copper coated on both sides, as is used for the construction of microstrip circuits was employed for the substrate 12 in the illustrative example. The substrate 12 had a thickness h=1.59 mm (1/16") and a material constant $\epsilon_r=2.3$. The dimensions of the ring 10 were: outer radius $r_a=5.8$ mm, inner radius $r_i=1.2$ mm, and cut-out angle $\alpha=75°$. The ring 10 was loaded by an open circuit (equivalent to a short circuit $\lambda/4$ away). Measurements in an anechoic chamber showed an 8 db reduction in radar cross-section at 9.6 GHz. The design frequency of the ring antenna (Cf. Wood) was 10 GHz.

The invention now being fully described, it will be apparent to one of ordinary skill in the art that many changes and modifications can be made thereto without departing from the spirit or scope of the invention as set forth herein.

The present disclosure relates to the subject matter disclosed in German Application P 37 22 793.0 of July 10th, 1987, the entire specification of which is incorporated herein by reference.

What is claimed:

1. A radar camouflage material for reducing the radar back-scatter cross section of a target object, said material comprising a layer of dielectric material having a plurality of spaced minimum-scatter type antenna elements disposed thereon, with said minimum-scatter type antenna elements each being terminated in a purely reactive manner such that a received wave reflected at the termination substantially cancels the corresponding scattered wave; and wherein: said antenna type elements are each a ring antenna type element configured as an open ring whose ends are connected with a line section of a length to cause said substantial cancellation; each said ring antenna type element is formed as an open ring shaped conductive film disposed on one surface of said layer of dielectric material: and the open portions of said rings are oriented in random directions in the plane of said one surface.

2. A radar camouflage material as defined in claim 1, wherein said line section is an open-circuited line section of a length to cause said substantial cancellation.

3. A radar camouflage material as defined in claim 1, wherein said line section is a short-circuited line section of a length to cause said substantial cancellation.

4. A radar camouflage material as defined in claim 1 wherein a continuous film of metal is disposed on the opposite surface of said layer of dielectric material.

5. A radar camouflage material as defined in claim 1 wherein only said ring antenna type elements disposed on said one surface of said layer of dielectric material.

6. A radar camouflage material as defined in claim 1 wherein said ring antenna type elements arranged in an array with a spacing of $\lambda/4$.

7. A radar camouflage material as defined in claim 3 wherein said ring antenna type elements are arranged in an array with a spacing of $\lambda/4$.

8. A radar camouflage material as defined in claim 3 wherein only said conductive films are disposed on said one surface.

* * * * *